US011333350B2

(12) United States Patent
Zou et al.

(10) Patent No.: US 11,333,350 B2
(45) Date of Patent: May 17, 2022

(54) DEVICE WITH STEAM GENERATION FUNCTION

(71) Applicant: Jianhan Zou, Xiamen (CN)

(72) Inventors: Jianhan Zou, Xiamen (CN); Guoyun Tang, Xiamen (CN); Hehai Liu, Xiamen (CN)

(73) Assignee: Jianhan Zou, Xiamen (CN)

( * ) Notice: Subject to any disclaimer, the term of this patent is extended or adjusted under 35 U.S.C. 154(b) by 13 days.

(21) Appl. No.: 16/968,109

(22) PCT Filed: Sep. 30, 2019

(86) PCT No.: PCT/CN2019/109504

§ 371 (c)(1),
(2) Date: Aug. 6, 2020

(87) PCT Pub. No.: WO2020/064010

PCT Pub. Date: Apr. 2, 2020

(65) Prior Publication Data

US 2021/0222870 A1 Jul. 22, 2021

(30) Foreign Application Priority Data

Sep. 29, 2018 (CN) ..... 201811147533.7

(51) Int. Cl.
*F22B 37/00* (2006.01)
*F22B 33/18* (2006.01)
*D06F 75/14* (2006.01)

(52) U.S. Cl.
CPC ..... *F22B 37/00* (2013.01); *F22B 33/18* (2013.01); *D06F 75/14* (2013.01)

(58) Field of Classification Search
CPC ..... F22B 37/00; F22B 37/26; F22B 33/18; D06F 75/08–18
See application file for complete search history.

(56) References Cited

U.S. PATENT DOCUMENTS 2,233,048 A * 2/1941 Eckstein ..... D06F 75/16 38/77.82
2,506,941 A * 5/1950 Scott ..... D06F 75/16 38/77.82

(Continued)

FOREIGN PATENT DOCUMENTS

CN 101476713 A 7/2009
CN 201962530 U 9/2011

(Continued)

OTHER PUBLICATIONS

International Search Report dated Jan. 2, 2020, issued to International Application No. PCT/CN2019/109504.

*Primary Examiner* — Ismael Izaguirre
(74) *Attorney, Agent, or Firm* — Stein IP, LLC

(57) ABSTRACT

A device with a steam generation function comprises a water storage cavity, a heating cavity with a steam outlet, a guide channel for communicating the water storage cavity with the heating cavity, and a heating element configured in the heating cavity, wherein the heating cavity has a first chamber and a second chamber communicated with the first chamber, and the first chamber is located on one side of the second chamber; and the heating element is configured in the first chamber, and the steam outlet is formed in the second chamber and is spaced from the first chamber in the horizontal direction by a preset first distance to prevent boiling water in the first chamber from being ejected via the steam outlet. The device provided by the present invention is safe in use.

7 Claims, 2 Drawing Sheets

(56) References Cited

U.S. PATENT DOCUMENTS

| | | | | | |
|---|---|---|---|---|---|
| 2,861,365 | A | * | 11/1958 | Block | D06F 75/16 38/77.82 |
| 4,366,367 | A | * | 12/1982 | Mazzucco | D06F 87/00 219/245 |
| 4,496,826 | A | * | 1/1985 | Osrow | D06F 75/14 219/245 |
| 5,279,055 | A | * | 1/1994 | Eckert | D06F 75/18 219/254 |
| 7,389,597 | B1 | | 6/2008 | Chen | 38/77.83 |

FOREIGN PATENT DOCUMENTS

| | | | |
|---|---|---|---|
| CN | 207455553 | U | 6/2018 |
| CN | 108561870 | A | 9/2018 |
| CN | 109058967 | A | 12/2018 |
| CN | 209196821 | U | 8/2019 |

* cited by examiner

【FIG. 1】
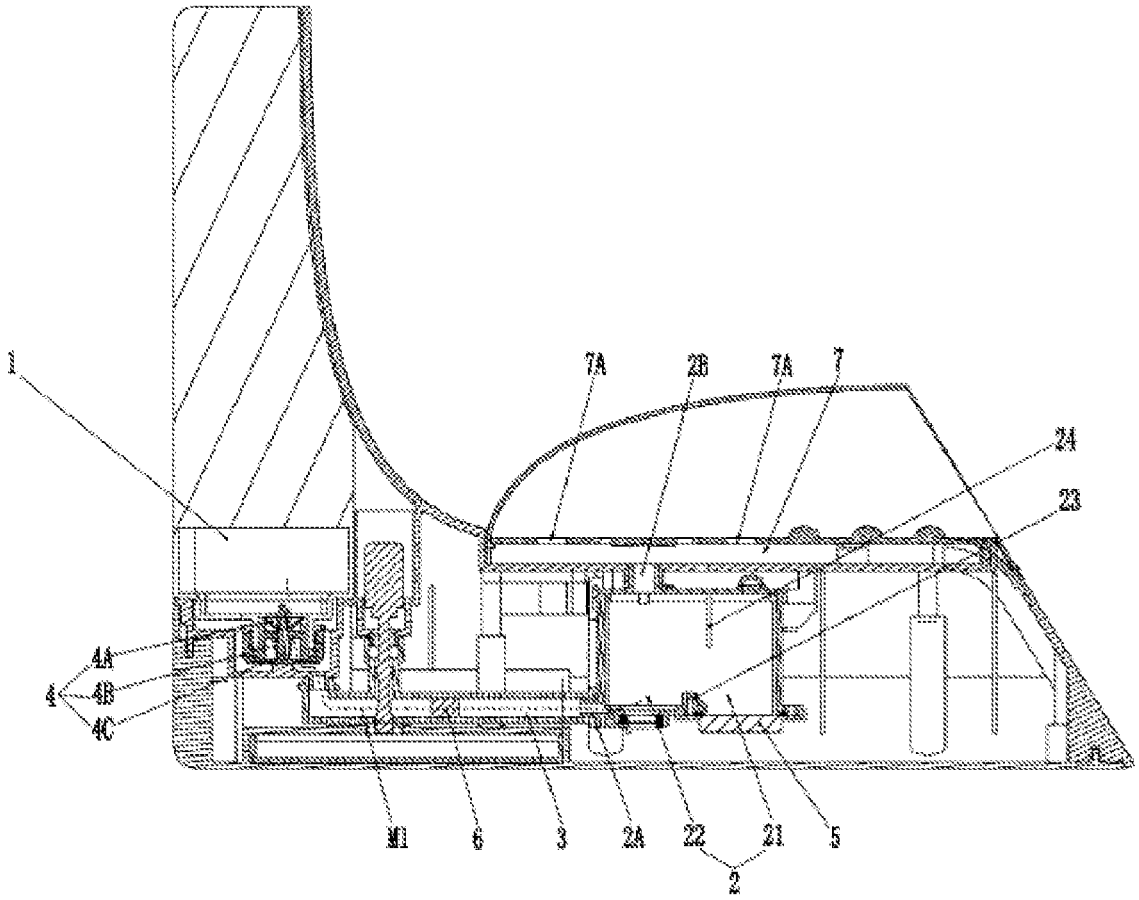

【FIG. 2】
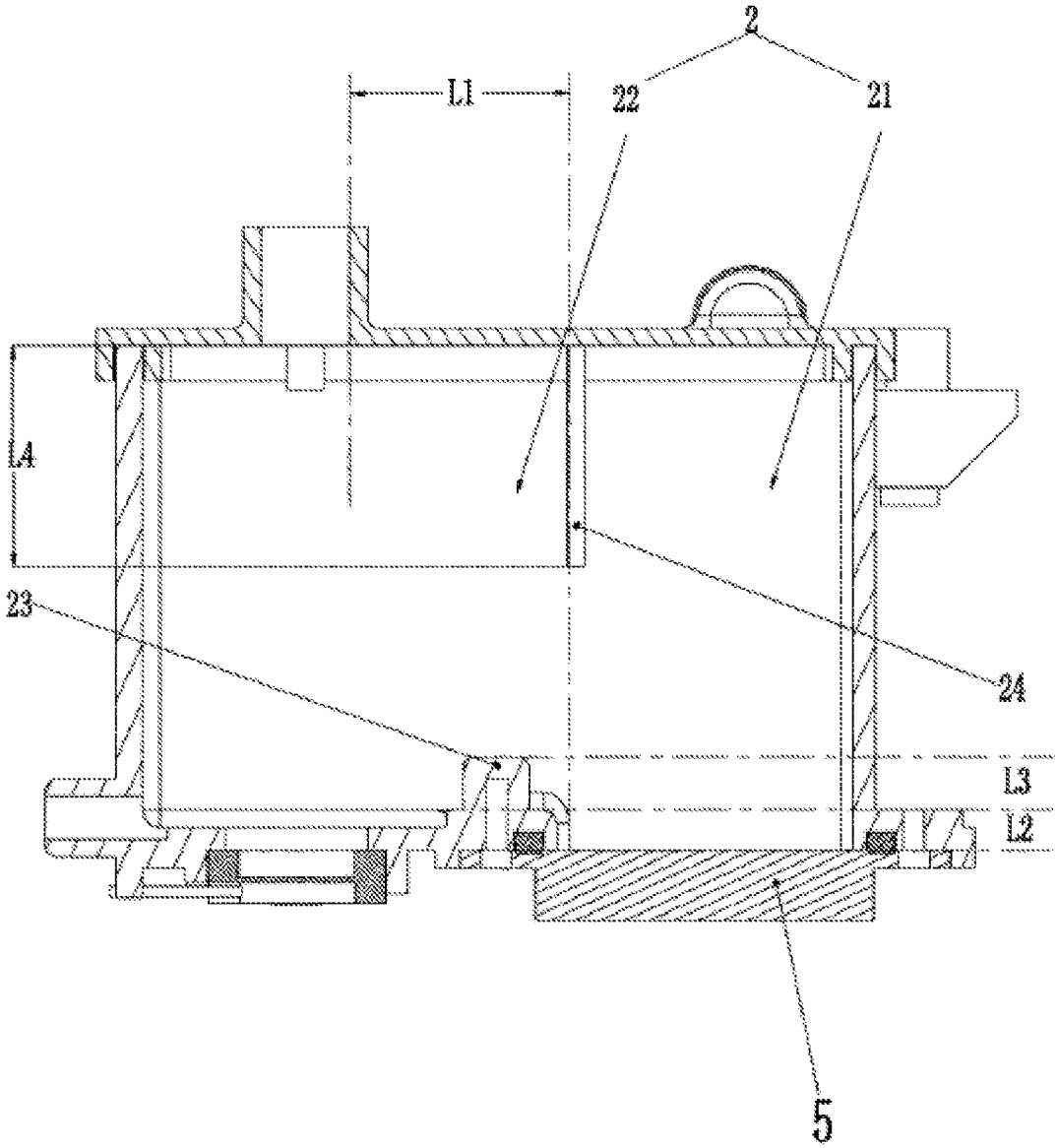

DEVICE WITH STEAM GENERATION FUNCTION

CROSS-REFERENCE TO RELATED APPLICATIONS

This application is a national stage of International Application No. PCT/CN2019/109504, filed Sep. 30, 2019, which claims the benefit of Chinese Application No. 201811147533.7, filed Sep. 29, 2018, in the China National Intellectual Property Administration, the disclosures of which are incorporated herein by reference.

TECHNICAL FIELD

The invention relates to a device with a steam generation function, such as a garment steamer, a steam footbath, or a hand steamer.

DESCRIPTION OF RELATED ART

Common devices with a steam generation function, such as garment steamers and steam footbaths, typically include a water storage cavity, a heating cavity with a steam outlet, a guide channel for communicating the water storage cavity with the heating cavity, and a heating element configured in the heating cavity. The heating element of existing garment steamers and steam footbaths is generally configured on the bottom wall of the heating cavity, and the steam outlet is generally configured above the heating element in the vertical direction. Under such configuration, steam may be directly ejected via the steam outlet when water is heated and boiled in the heating cavity, thus resulting in potential safety hazards. In view of this, the present application is put forward.

BRIEF SUMMARY OF THE INVENTION

Technical Issue

The technical issue to be settled by the invention is to provide a device with a steam generation function to eliminate potential safety hazards of existing garment steamers and steam footbaths caused by direct ejection of boiling water via the steam outlet.

Solution to the Issue

To settle the aforesaid technical issue, the invention provides a device with a steam generation function, which comprises a water storage cavity, a heating cavity with a steam outlet, a guide channel for communicating the water storage cavity with the heating cavity, and a heating element configured in the heating cavity, wherein the heating cavity has a first chamber and a second chamber communicated with the first chamber, and the first chamber is located on one side of the second chamber; and the heating element is configured in the first chamber, and the steam outlet is formed in the second chamber and is spaced from the first chamber in the horizontal direction by a preset first distance to prevent boiling water in the first chamber from being ejected via the steam outlet.

Preferably, a bottom wall of the first chamber is lower than a bottom wall of the second chamber.

Preferably, the first chamber and the second chamber have a common first wall which is located at a junction of the bottom wall of the first chamber and the bottom wall of the second chamber, and the top surface of the first wall is higher than the bottom wall of the first chamber.

Preferably, the first chamber and the second chamber have a common second wall which is located at a junction of a top wall of the first chamber and a top wall of the second chamber; and the second wall is used for preventing boiling liquid in the first chamber from entering the second chamber, and an air hole or an air channel for communicating the first chamber with the second chamber is formed in the second wall.

Preferably, the device has an expansion chamber communicated with the steam outlet and used for steam expansion, and multiple steam diffusion ports are formed in the expansion chamber.

Preferably, a check valve for preventing water from flowing back into the water storage cavity is configured in the guide channel.

Preferably, the device is a garment steamer, a steam footbath, or a hand steamer.

By adoption of the above technical solution, the invention fulfills the following technical effects:

1. According to the technical solution of the present application, the heating cavity has the first chamber and the second chamber which are spaced from each other in the left-right direction, the heating element is configured in the first chamber, and the steam outlet is formed in the second chamber and is spaced from the first chamber in the horizontal direction by a preset first distance, so that boiling water under the direct action of the heating element will not be directly ejected via the steam outlet like the prior art, thus eliminating potential safety hazards of the prior art;

2. The bottom wall of the first chamber is lower than the bottom wall of the second chamber, so that when there is a little water in the heating cavity, the water can be collected in the first chamber to be heated; and meanwhile, by adoption of such design, the junction of the bottom wall of the first chamber and the bottom wall of the second chamber is inclined to ensure that boiling water will not be directly ejected into the second chamber when there is a little water in the heating cavity.

3. Through the design of the first wall, boiling water in the first chamber will not gush into the second chamber and will not be ejected via the steam outlet;

4. Through the design of the second wall, boiling water in the first chamber will not gush into the second chamber and will not be ejected via the steam outlet when the water level in the heating cavity is high.

BRIEF DESCRIPTION OF THE SEVERAL VIEWS OF THE DRAWINGS

FIG. 1 is a sectional view of a device with a steam generation function in one embodiment of the present application;

FIG. 2 is a partial sectional view of a heating cavity in FIG. 1.

DETAILED DESCRIPTION OF THE INVENTION

To make the purposes, technical solutions and advantages of the implementations of the invention clearer, the technical solutions of the implementations of the invention are explicitly and completely described below in conjunction with the accompanying drawings of the implementations. Obviously, the implementations described hereinafter are merely illustrative ones, and are not all possible ones of the invention.

All other implementations obtained by those ordinarily skilled in the art on the basis of the following ones without creative labor should also fall within the protection scope of the invention. Therefore, the following detailed description of the implementations provided by the accompanying drawings is not intended to limit the protection scope of the invention, and is merely used to illustrate specified implementations of the invention.

Referring to FIG. 1 and FIG. 2, in one embodiment, a device with a steam generation function provided by the present application is a garment steamer and comprises a water storage cavity 1, a heating cavity 2 with a steam outlet 2B, a guide channel 3 for communicating the water storage cavity 1 with the heating cavity 2, and a heating element 5 configured in the heating cavity 2. A water outlet valve mechanism 4 is configured between the water storage cavity 1 and the guide channel 3. A control mechanism (not shown) is electrically connected to the heating element.

Referring to FIG. 1, water from the water storage cavity 1 flows into the heating cavity 2 approximately along a path shown by dotted line Ml. The water outlet valve mechanism 4 comprises a water valve 4A, a spring 4B and a guide pillar 4C, wherein the water valve 4A is disposed around the guide pillar 4C, the spring 4B abuts against the lower end of the water valve 4A and the lower end of the guide pillar 4C, and the water valve 4A fits a water outlet of the water storage cavity 1 in size and can compress the spring 4B under the effect of a water pressure to allow water to flow into the guide channel 3. In this embodiment, a check valve 6 for preventing water flowing back into the water storage cavity 1 is configured in the guide channel 3, and the check valve 6 is a common structure and will no longer be detailed.

The heating cavity 2 has a first chamber 21 and a second chamber 22 communicated with the first chamber 21. In this embodiment, the first chamber 21 is located on the right side of the second chamber 22. A water inlet 2A of the heating cavity 2 is formed in the second chamber 22 which is communicated with the guide channel 3. The heating element 5 is configured in the first chamber 21 and is specifically configured on the bottom wall of the first chamber 21. The steam outlet 2B is formed in the second chamber 22 and is spaced from the first chamber 21 in the horizontal direction by a preset first distance L1 to prevent boiling water in the first chamber 21 from being ejected via the steam outlet 2B. Preferably, the first distance L1 ranges from 1 cm to 10 cm, such as 3 cm. In another embodiment, the first chamber 21 may be located on the left side of the second chamber 22. In another embodiment, the water inlet 2A of the heating cavity 2 may be formed in the first chamber 21 which is communicated with the guide channel 3.

In this embodiment, a bottom wall of the first chamber 21 is lower than a bottom wall of the second chamber 22, and a height difference L2 between the bottom wall of the first chamber 21 and the bottom wall of the second chamber 22 ranges from 0.2 cm to 5 cm, such as 3 cm.

In this embodiment, the first chamber 21 and the second chamber 22 have a common first wall 23 which is located at a junction of the bottom wall of the first chamber 21 and the bottom wall of the second chamber 22; and a top surface of the first wall 23 is higher than the bottom wall of the first chamber 21, and a height difference L3 between the top surface of the first wall 23 and the bottom wall of the first chamber 21 ranges from 0.2 cm to 5 cm, such as 4 cm.

In this embodiment, the first chamber 21 and the second chamber 22 have a common second wall 24 which is located at a junction of a top wall of the first chamber 21 and a top wall of the second chamber 22. The second wall 24 is used for preventing boiling liquid in the first chamber 21 from entering the second chamber 22, and an air hole or an air channel (not shown) for communicating the first chamber with the second chamber is formed in the second wall 24. An extension distance L4 of the second wall 24 in the vertical direction ranges from 1 cm to 8 cm, such as 4 cm.

In this embodiment, the device has an expansion chamber 7 communicated with the steam outlet 2B and used for steam expansion, and multiple steam diffusion ports 7A are formed in the expansion chamber 7. The multiple steam diffusion ports 7 may be regularly distributed to enlarge the steam diffusion area.

In another embodiment, the device may be a steam footbath, a hand steamer, or a face steamer.

The invention claimed is:

1. A device with a steam generation function, comprising a water storage cavity (1), a heating cavity (2) with a steam outlet (2B), a guide channel (3) for communicating the water storage cavity (1) with the heating cavity (2), and a heating element (5) configured in the heating cavity (2), wherein the heating cavity (2) has a first chamber (21) and a second chamber (22) communicated with the first chamber (21), and the first chamber (21) is located on one side of the second chamber (22); and the heating element (5) is configured in the first chamber, and the steam outlet (2B) is formed in the second chamber (22) and is spaced from the first chamber (21) in a horizontal direction by a preset first distance (L1) to prevent boiling water in the first chamber (21) from being ejected via the steam outlet (2B);

wherein the first chamber (21) and the second chamber (22) have a common second wall (24) which is located at a junction of a top wall of the first chamber (21) and a top wall of the second chamber (22); and the second wall is used for preventing boiling liquid in the first chamber (21) from entering the second chamber (22), and an air hole or an air channel for communicating the first chamber (21) with the second chamber (22) is formed in the second wall (24).

2. The device with a steam generation function according to claim 1, wherein a bottom wall of the first chamber (21) is lower than a bottom wall of the second chamber (22).

3. The device with a steam generation function according to claim 1, wherein the first chamber (21) and the second chamber (22) have a common first wall (23) which is located at a junction of a bottom wall of the first chamber (21) and a bottom wall of the second chamber (22), and a top surface of the first wall (23) is higher than the bottom wall of the first chamber (21).

4. The device with a steam generation function according to claim 1, wherein the device has an expansion chamber (7) communicated with the steam outlet (2B) and used for steam expansion, and multiple steam diffusion ports (7A) are formed in the expansion chamber (7).

5. The device with a steam generation function according to claim 1, further comprising a check valve (6) for preventing water from flowing back into the water storage cavity (1) is configured in the guide channel (3).

6. The device with a steam generation function according to claim 1, wherein the device is a garment steamer, a steam footbath, a hand steamer or a face steamer.

7. The device with a steam generation function according to claim 2, wherein the first chamber (21) and the second chamber (22) have a common first wall (23) which is located at a junction of the bottom wall of the first chamber (21) and the bottom wall of the second chamber (22), and a top surface of the first wall (23) is higher than the bottom wall of the first chamber (21).

* * * * *